United States Patent [19]

Dalo et al.

[11] 4,099,351

[45] Jul. 11, 1978

[54] INFLATABLE STRUCTURES

[76] Inventors: Pierre Dalo, 12 rue du Dr Kurzenne, Jouy-en-Josas, France, 78350; Jean Dalo, Rue Beaurepaire, Roinville sur Dourdan, France, 91410

[21] Appl. No.: 747,487

[22] Filed: Dec. 6, 1976

[30] Foreign Application Priority Data

Jan. 19, 1976 [FR] France ..... 76 01208
Jun. 9, 1976 [FR] France ..... 76 17332

[51] Int. Cl.[2] ..... E04B 1/34
[52] U.S. Cl. ..... 52/2
[58] Field of Search ..... 52/2, 63, 222

[56] References Cited

U.S. PATENT DOCUMENTS

| | | | |
|---|---|---|---|
| 2,812,769 | 11/1957 | Schaefer et al. | 52/2 |
| 3,035,590 | 5/1962 | Helmers | 52/2 |
| 3,346,441 | 10/1967 | Bird | 52/2 |
| 3,742,657 | 7/1973 | Price | 52/2 |
| 3,779,847 | 12/1973 | Turner | 52/2 X |

*Primary Examiner*—Ernest R. Purser
*Assistant Examiner*—Carl D. Friedman
*Attorney, Agent, or Firm*—J. Harold Nissen

[57] ABSTRACT

An inflatable and deflatable air supported structure which lies flat in its uninflated condition and has a substantially spherical shape in its inflated condition. The structure includes a wall formed from a sheet of flexible material having a first perimeter greatest in its flat condition, the peripheral edge of the perimeter in the inflated condition is rounded in shape and forms a second outer perimeter smaller than the first perimeter. A plurality of cables connected with the sheet extend from the peripheral edge to an inner central portion dividing the sheet into gores between each pair of adjacent cables. The outer ends of the cables extend from beyond the outer peripheral edge to the inner central portion. Two anchorings are provided. One anchoring connects the outer ends of the cables to the ground to connect the peripheral edge to the ground, and the other anchoring connects the cable's inner ends and the central portion to form an air-tight chamber with the flexible material inflated. The other anchoring anchors the central portion to the ground.

8 Claims, 12 Drawing Figures

INFLATABLE STRUCTURES

This invention relates to inflatable structures, constructed of flexible material and suitable, when in the slightly pressurised inflated state, of being used as shelters, for example for warehouses, stores, large shops, workshops, gymnasia, swimming pools and the like.

Such structures have been known for a long time and widely used, due to their small bulk in the folded state, which makes it easy to dismantle and transport them from one place of use to another. Nevertheless, these known structures always suffer from the disadvantage of being made up of an assembly of separate elements having the three dimensional shape and dimensions corresponding to the final volume of the inflated structure. In fact, such a technique demands a complex succession of studies, drawings, cut-outs and assemblies of said elements.

Moreover, the inflated structure is subjected to very high stresses, which lead to some weakness of the structure, and the attempt has been made to counteract this defect by taking up said stresses by means of a flexible metal wire or cord enveloping the structure and anchored to the ground at its periphery. However, for the same reasons, this cord is also very complicated to make.

This invention overcomes these disadvantages by means of a fundamentally different design of the elements which make up the structure. According to the invention, the structure is constituted of a substantially plane flexible sheet, the dimensions of which when flat are greater than the base of the inflated structure, the raising of the central zone of this sheet under the effect of the over-pressure of inflation causing a reduction in the ground perimeter of said sheet until it coincides with that of the inflated structure, at which point said perimeter is anchored to the ground, this anchoring being carried out by means of cables which converge towards the upper zone of the structure for the purpose of compensating, by the creation of entases, the differences in surface area of the sheet after inflation.

The structure according to this invention may have any rounded geometrical shape. Thus, according to one embodiment thereof, the sheet is circular and, when inflated, its perimeter decreases proportionally to its height. According to one variant of this embodiment, the central zone is concave, the anchoring cables being brought downwards in order to decrease the total height of the inflated structure without modifying the area covered.

Figure 1:
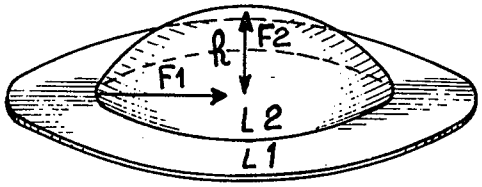
Figure 2:
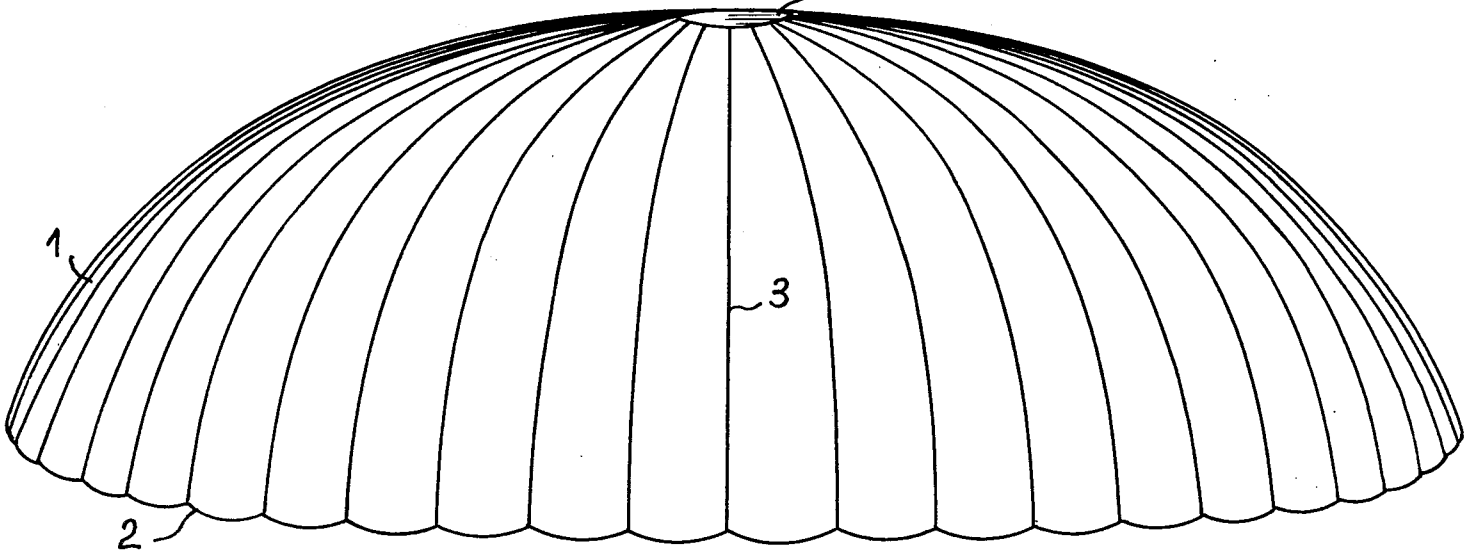
Figure 3:
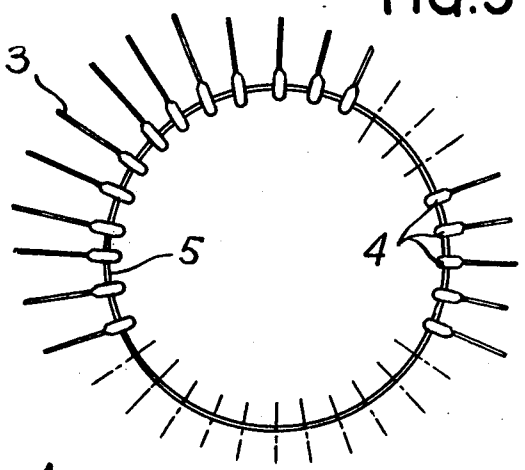
Figure 4:
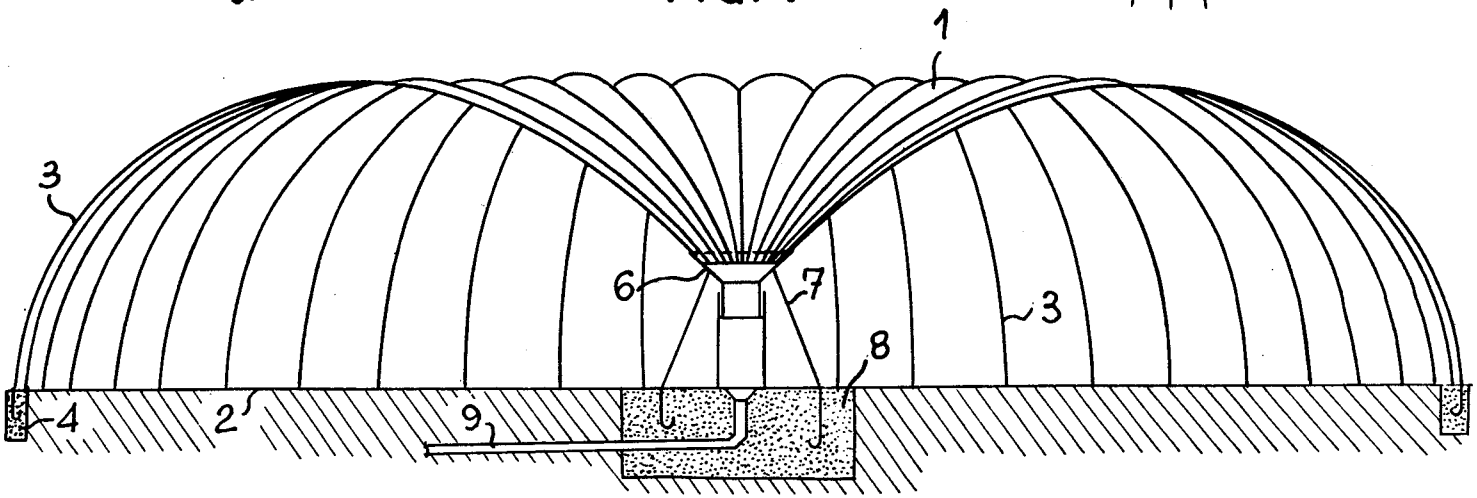
Figure 5:
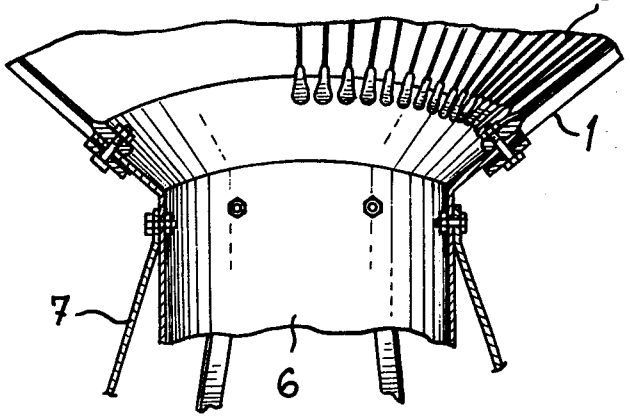

A description of the invention will now be given with reference to the attached drawing, which illustrates several embodiments thereof and in which:

FIG. 1 illustrates the change from a flat circular sheet to a spherical inflated structure, FIG. 2 illustrates the reinforcement of a structure of the type of FIG. 1 by radial cables, FIG. 3 shows a detail of the fixing of the cables of FIG. 2 in the central zone of the structure, FIG. 4 is a section through a variant of FIG. 2 and FIG. 5 is a view analogous to FIG. 3 in the case of the variant of FIG. 4.

Figure 6:
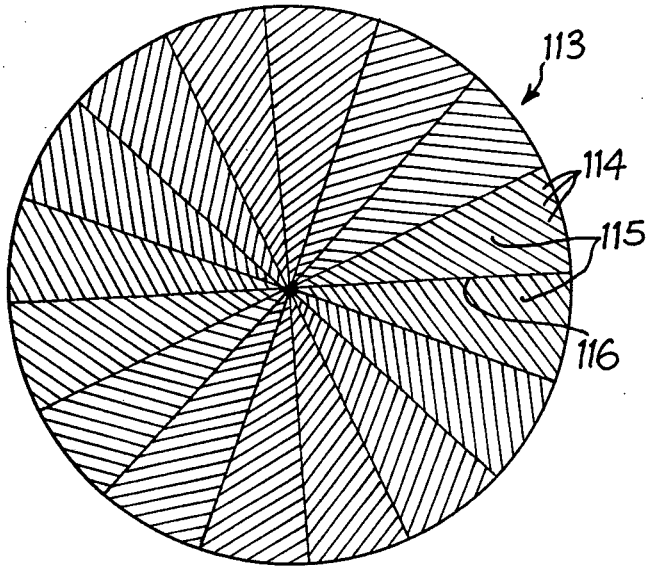

FIG. 6 shows the arrangement of the fabric cloths or canvasses permitting the radial deformation of the sheet.

Figure 7A:
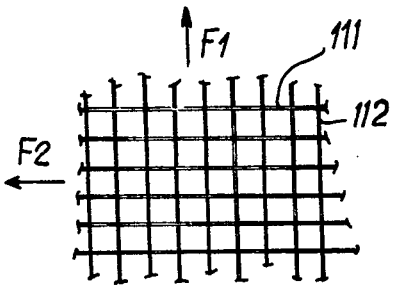
Figure 7B:
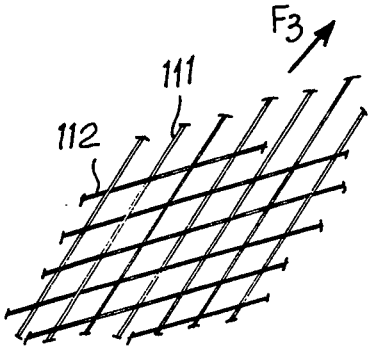
Figure 8A:
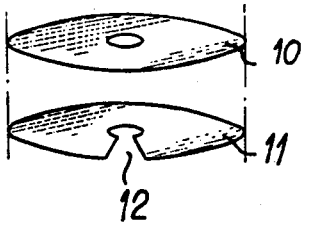
Figure 8B:
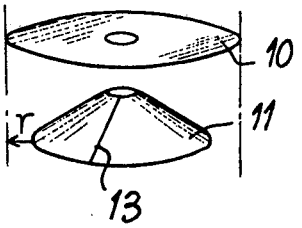
Figure 9:
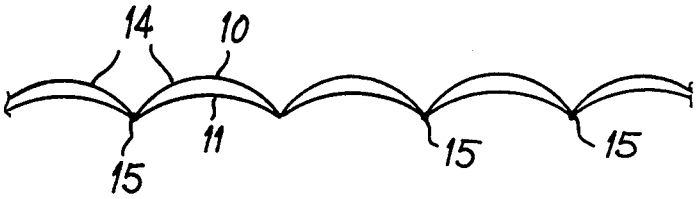
Figure 10:
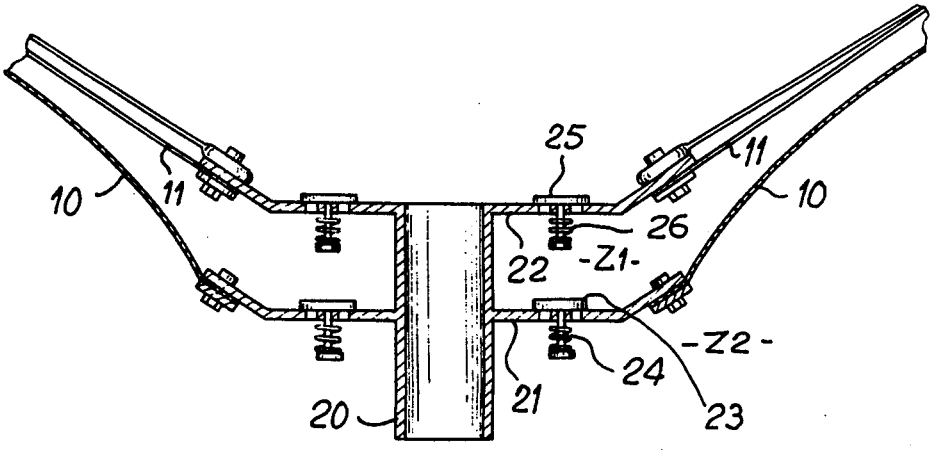

FIGS. 7*a* and 7*b* illustrate the process of deforming of the fabric,

FIGS. 8*a* and 8*b* show the formation of the two sheets intended for forming a double-walled structure according to one of the forms of embodiment of the invention, FIG. 9 shows, in horizontal section, a portion of the double-walled structure when inflated and FIG. 10 shows, in axial section, the central portion of the structure equipped with the pressure regulating devices.

Referring first of all to FIGS. 1 and 2, it can be seen that the invention consists, starting from a circle of flexible sheet having a perimeter $L_1$, of inflating this sheet in order to cause it to adopt a spherical shape, the ground perimeter of which is a circle of perimeter $L_2$, and the height of which is $h$. It is easy to establish the relationship between $h$ and $L_2$; if we consider the angle $\alpha$ which defines the spread angle of the spherical segment of perimeter of $L_1$, we can write the following:

$$\alpha = L_1/R \text{ (expressed in radians)}$$

with the angle $\alpha$ defined in this way, the relationship between $h$ and $L_2$ can be written $$L_2/h = \tan \alpha/2 \qquad (1)$$

It is therefore easy to determine the dimension by which the sheet will shrink in the direction $F_1$, or by how much it will rise in the direction $F_2$.

In practice, the inflated structure will not be rigorously spherical, but will adopt the well-known appearance described as "of water drop shape;" it is of course to be understood that the invention covers any closely similar or analagous shape, allowing also for the possibility of a base perimeter which is not exactly circular, for example oval.

In all cases, there is practically no deformation or overstretching of the material of the sheet, thus eliminating all sources of weakness in the structure, which simply changes from a plane to an inflated shape, that is to say from two to three dimensions.

This embodiment is illustrated in its practical realisation in FIGS. 2 and 3. These figures show a structure of spherical appearance, constituted of a sheet 1 anchored to the ground at its periphery 2 by cables 3. Cables 3 are anchored at one end 4 thereof to the ground and are connected together at their other ends 4*a* by a ring 5. As a result of these cables, the excess of area of the sheet, resulting from its forming into shape, is compensated: the difference of radius between the concave portion of the entases, along which the cables pass, and their convex portion, the highest part, corresponds to a slight stretching of the sheet, which is larger if the curvature is more pronounced.

In FIGS. 4 and 5, the height $h$, which would have been too large, has been compensated by connecting the ends 4*a* of the cables 3, not to a ring 5 but to a conical connecting element 6, itself anchored to the ground by tension members 7 buried in a concrete block 8.

Apart from the reduction in height with a corresponding decrease in the slope of the walls at their base, this arrangement ensures proper run-off of water, which can be removed through a discharge conduit 9. Moreover, the forces on the cables are divided by 2.

The inflatable structures according to this invention can of course be of any other shape suitable for their application, provided that they fulfil the essential conditions defined above.

Nevertheless, a certain number of improvements in detail can with advantage be applied in practice. In the first place, although according to this invention as described above there is practically no deformation or overstretching of the material of the plane sheet at the time when it is inflated, in practice, in certain limited zones in which the curvatures are greatest, the material is nevertheless subjected to forces which can lead to a slight overstretching, which may amount to from 1 to 10%, depending upon the number of curves and of cables. Moreover, if the fabric used is subjected to these forces in the direction of the warp or weft, its ability to distend will be very small, so that there is a risk of folds forming in the zones through which the cables pass, notably where the curves are greatest. In order to eliminate this risk, provision is made according to this invention, to make up the sheet by joining together cloths arranged in such a fashion that the diagonal of the weave is substantially in the direction of the radius of the sheet. Since the forces are then exerted in a diagonal direction across the fabric, the threads can, by sliding one upon the other, permit a deformation of the fabric in the direction of a radial elongation of the cloth.

Secondly, the invention also relates to means intended for assuring thermal insulation of the interior of the structure.

It is well-known that an important disadvantage of this type of structure is their mediocre or indeed zero thermal insulation. A usual means of assuring good insulation is clearly to form the structure with a double wall, the problem which then arises being that of connecting together two sheets, both of which are in accordance with the characteristics of this invention.

The invention provides a solution to this problem. According to the invention, two identical sheets being superimposed flat, a difference in periphery is created between the two sheets, in such a way that the area of the upper sheet is substantially greater than that of the lower sheet.

According to a first form of embodiment, the lower sheet is formed by joining together identical sectors, having an apex angle slightly less than 360°/N, where N is the number of sectors, so that in this way a very slightly conical circular sheet is obtained, having a periphery less than that of the upper sheet.

The two sheets are then inflated in the same manner as the single sheet, the entases of the double wall being created in the same way by cables, and being separated with a curvature which is slightly different along each gore. According to a second from of embodiment, by contrast, the periphery and therefore the area of the upper sheet is increased, without modifying the lower sheet. This can be achieved, for example, by making up this upper sheet by joining together identical sectors having an apex angle slightly greater than 360°/N, where N is the number of sectors. The sheet made up in this way will of necessity be undulating or folded along a certain number of radii, which will enable it to adapt to the aforementioned deformations during inflation. Finally according to this invention, in order to keep the two sheets suitably inflated, a fraction of the overpressure produced inside the structure is transmitted to the zone between the two sheets by a system of pressure-adjusted valves. Another system of pressure-adjusted valves ensures, for safety purposes, the escape towards the outside of any unacceptable or accidental excess quantity in the pressure between the two sheets. As can be seen in FIGS. *7a* and *7b*, a woven fabric, such as is used to form the structure according to this invention, is made up of warp threads 111 and weft threads 112, formed together in a right-angle weave. If a tensile force $F_1$ is exerted in the direction of the warp or $F_2$ in the direction of the weft, the deformation of the fabric is necessarily limited by the coefficient of elongation of the threads 111 and 112, which in the case particularly of threads of synthetic plastics material is relatively small.

It follows that, if the circular sheet 43 serving for constituting the inflatable structure according to this invention, is formed of sectors in which the threads 111 and 112 are respectively in the direction of concentric circles and radii of this sheet 113, the possible deformation elongation of these fibres will be relatively limited, thus leading to a risk of folds, notably in the zone where the gores are formed by curving or arching of the material between the cables bounding the sectors.

By contrast, if as shown in FIG. 6, the cloths 114 constituting each sector 115, the sectors being joined together along their radii 116, are oriented diagonally relative to the direction of the radii of the circle 113, the configuration of FIG. *7b* will occur and when a radial force is exerted upon one of these sectors, the force is situated, in relation to the threads 111 and 112, in the direction of the arrow $F_3$, that is to say it is diagonal. In this case, the threads 111 and 112 slide one upon another and the square of threads shown in FIG. *7a* adopts the appearance of FIG. *7b*, in which the threads 111 and 112 are no longer at right angles to one another but form acute and obtuse angles, with diagonal elongation resulting therefrom.

The consequence of the deformation of the square of FIG. *7a* in accordance with FIG. *7b* under the effect of the forces in direction $F_3$, that is to day radially at the instant at which the structure is inflated, and of the formation of the corresponding gores at each of the sectors 115, is that the material forming the structure deforms in the desired direction without causing folds in the zones in which there would be a risk of the forces creating such folds. Reference will now be made to FIGS. *8a*, *8b* and 9, illustrating the make-up of the inflatable structure according to this invention but with a double wall for the purpose of assuring thermal insulation of the interior of the structure, in accordance with the first form of embodiment mentioned in the preamble.

According to this invention, the double-walled structure is initially composed of two equal circular sheets 10 and 11, as shown in FIG. *8a*. In order that the sheet 11 shall be capable of becoming situated inside the sheet 10, it is necessary that its peripheral development shall be less than that of the sheet 10. In order to attain this result, the sheet 11 is made up by joining together mutually identical sectors 113, having an apex angle slightly less than 360°/N, where N is the number of sectors and in this way a flattened sheet 11 with one missing sector 12 is obtained; when the two sides of this sector are connected together at 13, as shown in FIG. *8b*, the sheet 11 adopts the appearance of a very much flattened cone (this appearance being moreover not shown in FIG. *8b* but being quite definitely exaggerated in order to assist in an understanding of the description). In this way, the peripheral development of the element 11 is substantially less than that of the element 10, so that, when inflation is carried out, as shown especially in FIG. 9, the elements 10 and 11 fit one onto the other constituting a double wall, in which the gores 14 bounded by the cables 15 constituting the structure according to the invention of the Principal Patent, each comprise arched walls constituted of the portions of sheet 10 and 11. Due to the fact that the element 11 has a peripheral development slightly less than that of the element 10, the curvatures of this element 11 are slightly smaller than those of the element 10, which thus assures the geometry of these gores. In addition, in order to maintain the pressure inside the structure bounded by the double wall 10–11, a pressurised gas is blown into the structure, as is already known, but in order that the double-walled structure shall not possess any anomaly, it is clearly necessary that a slight overpressure shall exist also between the sheets 10 and 11.

Nevertheless, the overpressure between these sheets should be slightly less than the internal overpressure of the structure and in order to attain this objective, a system of valves is shown in FIG. 10.

According to the present invention the tube 20 of FIG. 10, which corresponds to the element 6 of FIG. 5, comprises two flanges or collars 21 and 22, to which there are attached the peripheries of the two sheets 10 and 11, as is shown diagrammatically in the drawing. In order to assure pressurisation in the zone $Z_1$, situated between the sheets 10 and 11, valves 23, calibrated for example by means of springs 24, or again by means of their own weight, permit a fraction of the overpressure in the internal zone $Z_2$ to be transmitted to the zone $Z_1$. In this way, the two sheets always remain, both of them, at an overpressure relative to the exterior and there is no risk of them "floating," relative to each other. In order to prevent the pressure from rising abnormally between the two sheets in the case of incorrect operation of the valve 23 or a rupture of the sheet 10, another valve 25 calibrated by a spring 26 permits escape of the pressure if this pressure exceeds a certain limiting value.

As a result of these various provisions, the double-walled structures according to this invention answer to the requirements listed in the preamble to the present application.

These provisions can of course be applied to improving the inflatable structure according to the Principal Patent, either singly or in any combination thereof, as can be seen from the claims which follow.

We claim:

1. An inflatable and deflatable air supported structure which lies in a flat plane and has a rounded geometrical shape in its uninflated condition and which has a substantially spherical shape in its inflated condition, comprising:

a wall including a sheet of rounded geometrical flexible material having an outer peripheral edge with a first perimeter which is greatest in its flat two-dimensional uninflated condition and having an inner central portion, said peripheral edge of the perimeter in the inflated three-dimensional condition of said sheet being substantially geometrically rounded in shape and forming a second outer perimeter which is less than the first perimeter of said sheet in its uninflated condition;

a plurality of cables extending radially from said outer peripheral edge to said inner central portion and connected with said sheet, said cables dividing said sheet into gores which are formed between each pair of adjacent cables, said cables having outer ends extending beyond said outer peripheral edge and inner ends extending to said inner central portion;

first anchoring means connecting said outer ends of said cables to the ground to anchor said sheet and the outer peripheral edge of said sheet to the ground; and, second anchoring means connected with said inner ends of said cables and said inner central portion to form an inner air-tight chamber with said flexible material in its inflated condition, said second anchoring means anchoring said inner central portion to the ground, and including a conical connecting element having one end connected with said inner ends of said cables, and tension members connected with the other end of said conical connecting element for connection thereof to the ground.

2. An inflatable and deflatable air supported structure which lies in a flat plane and has a rounded geometrical shape in its uninflated condition and which has a substantially spherical shape in its inflated condition, comprising:

a wall including a sheet of rounded geometrical flexible material having an outer peripheral edge with a first perimeter which is greatest in its flat two-dimensional uninflated condition and having an inner central portion, said peripheral edge of the perimeter in the inflated three-dimensional condition of said sheet being substantially geometrically rounded in shape and forming a second outer perimeter which is less than the first perimeter of said sheet in its uninflated condition;

a plurality of cables extending radially from said outer peripheral edge to said inner central portion and connected with said sheet, said cables dividing said sheet into gores which are formed between each pair of adjacent cables, said cables having outer ends extending beyond said outer peripheral edge and inner ends extending to said inner central portion;

said wall comprising two substantially similar sheets of flexible material each formed of a plurality of similar configurated gores, one of said sheets being juxtaposed above the other, and the apex angle of the gores of the upper sheet to form said lower sheet with an outer peripheral edge having a perimeter smaller than the perimeter of the outer peripheral edge of said upper sheet and slightly conical in shape;

first anchoring means connecting said outer ends of said cables to the ground to anchor said sheets to the ground; and, second anchoring means connected with said inner ends of said cables and said inner central portion to form an inner air-tight chamber with said flexible material in its inflated condition, said second anchoring means anchoring said inner central portion to the ground.

3. The structure according to claim 2, wherein said second anchoring means includes:

a ring; and, connectors for connecting said iner ends to said ring.

4. An inflatable and deflatable air supported structure which lies in a flat plane and has a rounded geometrical shape in its uninflated condition and which has a substantially spherical shape in its inflated condition, comprising:

a wall including two substantially circular flat sheets of rounded geometrical flexible material, one above the other, each of said sheets being formed of a plurality of sectors, the upper sheet having one additional sector than said lower sheet, said lower sheet in its uninflated condition having the appearance of a flattened cone and said upper sheet being substantially flat in its uninflated condition, and said two sheets forming a double wall in their inflated condition, said upper sheet forming an outer wall and said lower sheet forming an inner wall, said sheets each having an outer peripheral edge with a first perimeter which is greatest in its flat two-dimensional uninflated condition and having an inner central portion, said peripheral edge of the perimeter in the inflated three-dimensional condition of said sheets being substantially geometrically rounded in shape and forming a second outer perimeter which is less than the first perimeter of said sheets in its uninflated condition;

a plurality of cables extending radially from said outer peripheral edge to said inner central portion and connected with said sheets, said cables dividing said sheets into gores which are formed between each pair of adjacent cables, said cables having outer ends extending beyond said outer peripheral edge and inner ends extending to said inner central portion;

first anchoring means connected said outer ends of said cables to the ground to anchor said sheets and the outer peripheral edge of said sheets to the ground; and, second anchoring means connected with said inner ends of said cables and said inner central portion to form an inner air-tight chamber with said flexible material in its inflated condition, said second anchoring means anchoring said inner central portion to the ground.

5. The structure according to claim 4, wherein said gores in said two sheets are identical.

6. The structure according to claim 4, wherein said second anchoring means comprises:

a tubular member;

first and second collars connected to said tubular member one above the other and spaced from each other to form inner and outer collars, each of said collars including at least one valve; and, each of said sheets having an central opening surrounded by an inner peripheral edge;

said inner edge of said upper sheet being connected with said upper flange and said inner edge of said lower sheet being connected with said lower flange to form an air space therebetween; and, said valves including springs for calibration thereof, said valve on said inner collar being calibrated with said valve on said outer collar to open at a lower pressure to permit air to pass into the space between the double wall, and said valve on said outer collar being calibrated to open to prevent an abnormal pressure rise and a rupture of said inner wall.

7. An inflatable and deflatable air supported structure which lies in a flat plane and has a rounded geometrical shape in its uninflated condition and which has a substantially spherical shape in its inflated condition, comprising:

a double wall including two identical sheets of rounded geometrical flexible material having an outer peripheral edge with a first perimeter which is greatest in its flat two-dimensional uninflated condition and having an inner central portion, said peripheral edge of the perimeter in the inflated three-dimensional condition of said sheet being substantially geometrically rounded in shape and forming a second outer perimeter which is less than the first perimeter of said sheet in its uninflated condition, said two identical sheets being superimposed when flat and having a difference of periphery between said two sheets, in such a way that the area of the upper sheet is substantially greater than that of the lower sheet, one of said two sheets having mutually identical sectors joined together with an apex angle different from 360°/N, where N is the number of sectors;

a plurality of cables extending radially from said outer peripheral edge to said inner central portion and connected with said sheet, said cables dividing said sheets into gores which are formed between each pair of adjacent cables, said cables having outer ends extending beyond said outer peripheral edge and inner ends extending to said inner central portion;

first anchoring means connecting said outer ends of said cables to the ground to anchor said sheet and the outer peripheral edge of said sheet to the ground; and, second anchoring means connected with said inner ends of said cables and said inner central portion to form an inner air-tight chamber with said flexible material in its inflated condition, said second anchoring means anchoring said inner central portion to the ground.

8. Structure according to claim 7, including:

calibrated valves for maintaining said two sheets constituting a double wall suitably inflated, whereby a fraction of the overpressure created inside the structure is transmitted into the zone between the two sheets by said calibrated valves.

* * * * *